US011913463B2

(12) United States Patent
McGill et al.

(10) Patent No.: US 11,913,463 B2
(45) Date of Patent: Feb. 27, 2024

(54) GAS BEARING COMPRESSOR BACKUP POWER

(71) Applicant: TRANE INTERNATIONAL INC., Davidson, NC (US)

(72) Inventors: Seth M. McGill, Brookings, SD (US); Charles J. Peterson, La Crosse, WI (US); Robert S. Bakkestuen, West Salem, WI (US); Kevin P. Hughes, La Crosse, WI (US)

(73) Assignee: TRANE INTERNATIONAL INC., Davidson, NC (US)

( * ) Notice: Subject to any disclaimer, the term of this patent is extended or adjusted under 35 U.S.C. 154(b) by 383 days.

(21) Appl. No.: 17/314,534

(22) Filed: May 7, 2021

(65) Prior Publication Data

US 2022/0357087 A1 Nov. 10, 2022

(51) Int. Cl.

| | |
|---|---|
| ***F04D 27/00*** | (2006.01) |
| ***F04D 25/06*** | (2006.01) |
| ***F04D 29/057*** | (2006.01) |

(52) U.S. Cl.

CPC ..... *F04D 27/004* (2013.01); *F04D 25/06* (2013.01); *F04D 25/068* (2013.01); *F04D 27/00* (2013.01);

(Continued)

(58) Field of Classification Search

CPC ..... F04D 25/06; F04D 27/00; F04D 29/057; F04D 27/004; F04D 25/068;

(Continued)

(56) References Cited

U.S. PATENT DOCUMENTS

| | | | |
|---|---|---|---|
| 6,276,145 | B1 | 8/2001 | Sharpless et al. |
| 6,296,441 | B1 | 10/2001 | Gozdawa |

(Continued)

FOREIGN PATENT DOCUMENTS

| | | | |
|---|---|---|---|
| CN | 111520925 | A | 8/2020 |
| DE | 102009057100 | B4 | 6/2011 |

(Continued)

OTHER PUBLICATIONS

Extended European Search Report, European Patent Application No. 22170879.5, dated Aug. 31, 2022 (7 pages).

*Primary Examiner* — Kenneth J Hansen
*Assistant Examiner* — Benjamin Doyle
(74) *Attorney, Agent, or Firm* — Hamre, Schumann, Mueller & Larson, P.C.

(57) ABSTRACT

A compressor for a heat transfer circuit includes a variable frequency drive (VFD), an electric motor that rotates a driveshaft, bearing(s) for supporting the driveshaft, a backup gas supply, and a power supply. During a utility power interruption, the backup gas supply operates utilizing DC electrical power generated by a back electromotive force of the electric motor. A method of operating an electric power supply system for a compressor includes operating in a utility power mode and operating in a backup power mode during a utility power interruption. In the utility power mode, AC electrical power is supplied from the VFD to the motor. In the backup power mode, DC electrical power generated in the VFD by a back electromotive force of the motor it used to operate a backup gas supply to supply compressed working fluid to gas bearing(s) of the compressor.

18 Claims, 4 Drawing Sheets

(52) U.S. Cl.
CPC ..... *F04D 27/007* (2013.01); *F04D 29/057* (2013.01); *F04C 2240/54* (2013.01)

(58) Field of Classification Search
CPC ..... F04D 27/007; F04D 29/047; F04D 27/0261; F04C 2240/54; F25B 1/10; F25B 27/00; F25B 31/006; F25B 41/20; F25B 2600/021; F04B 37/12; F04B 35/04; F04B 39/00; F04B 49/06; F16C 32/0603; F16C 32/0614; F16C 2360/24
USPC ..... 417/44.1
See application file for complete search history.

(56) References Cited

U.S. PATENT DOCUMENTS

| | | | |
|---|---|---|---|
| 7,116,066 | B2 | 10/2006 | Lin |
| 7,928,620 | B2 | 4/2011 | Denk et al. |
| 8,156,757 | B2 | 4/2012 | Doty et al. |
| 10,451,104 | B2 | 10/2019 | Jiang et al. |
| 10,598,222 | B2 | 3/2020 | Devitt et al. |
| 2006/0056980 | A1 | 3/2006 | Yoo et al. |
| 2006/0125436 | A1 | 6/2006 | Lin |
| 2009/0174270 | A1 | 7/2009 | Denk et al. |
| 2016/0329854 | A9 | 11/2016 | West et al. |

FOREIGN PATENT DOCUMENTS

| | | | |
|---|---|---|---|
| EP | 3745050 | A1 | 12/2020 |
| KR | 101905478 | B1 | 8/2018 |

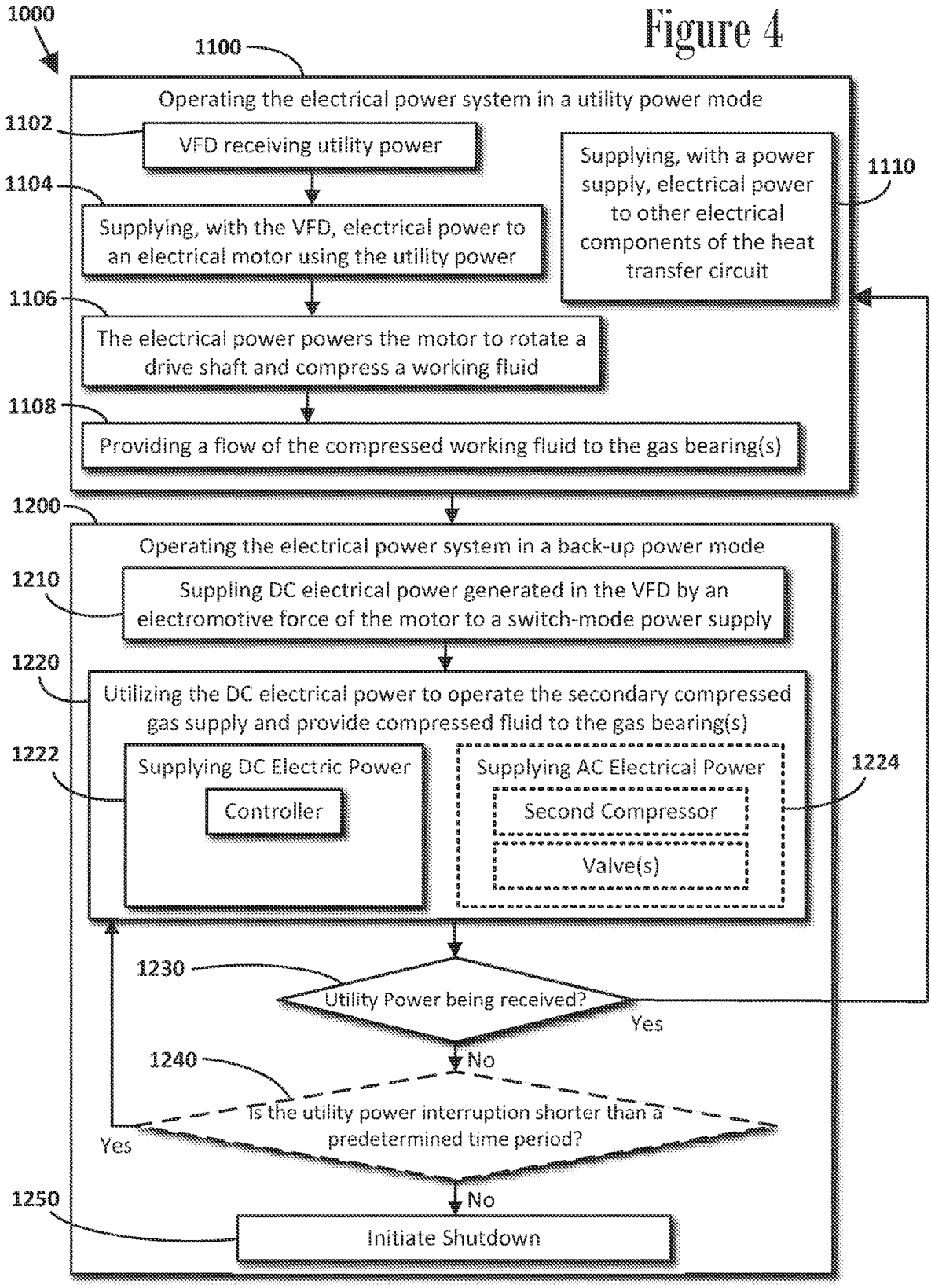
1000
Figure 4
1100
Operating the electrical power system in a utility power mode
1102
VFD receiving utility power
1104
Supplying, with the VFD, electrical power to an electrical motor using the utility power
1106
The electrical power powers the motor to rotate a drive shaft and compress a working fluid
1108
Providing a flow of the compressed working fluid to the gas bearing(s)
Supplying, with a power supply, electrical power to other electrical components of the heat transfer circuit
1110
1200
Operating the electrical power system in a back-up power mode
1210
Suppling DC electrical power generated in the VFD by an electromotive force of the motor to a switch-mode power supply
1220
Utilizing the DC electrical power to operate the secondary compressed gas supply and provide compressed fluid to the gas bearing(s)
1222
Supplying DC Electric Power
Controller
Supplying AC Electrical Power
Second Compressor
Valve(s)
1224
1230
Utility Power being received?
Yes
No
1240
Is the utility power interruption shorter than a predetermined time period?
Yes
No
1250
Initiate Shutdown

GAS BEARING COMPRESSOR BACKUP POWER

FIELD

The disclosure herein relates to a compressor in a heat transfer circuit of an HVACR system. More specifically, the disclosure herein relates to the power system for a compressor in a heat transfer circuit of an HVACR system.

BACKGROUND

HVACR systems are generally used to heat, cool, and/or ventilate an enclosed space (e.g., an interior space of a commercial building or a residential building, an interior space of a refrigerated transport unit, or the like). A HVACR system may include a heat transfer circuit that utilizes a working fluid for providing cooled or heated air to an area. The heat transfer circuit can include a compressor for compressing the working fluid. The compressor can include a motor that rotates a driveshaft to compress the working fluid. The compressor can include gas bearing(s) that support the driveshaft as the driveshaft rotates within the compressor. A building HVACR system (e.g., a residential HVACR system, a residential HVACR system, or the like) can utilize utility electrical power to power its electrical components (e.g., the compressor, the controller, valve(s), and the like).

BRIEF SUMMARY

A HVACR system can include a heat transfer circuit configured to heat or cool a process fluid (e.g., air, water and/or glycol, or the like). The heat transfer circuit includes a compressor that compresses a working fluid circulated through the heat transfer circuit. The compressor can include a driveshaft and one or more gas bearings for supporting the driveshaft. The compressor compresses the working fluid by rotating the driveshaft within the compressor. The gas bearing(s) support the driveshaft while the driveshaft rotates.

In an embodiment, the compressor includes a variable frequency drive (VFD) configured to utilize utility power, a permanent magnet motor electrically connected to the VFD and that rotates the driveshaft, one or more gas bearings, a backup gas supply fluidly connected to the one or more gas bearings, and a switch-mode power supply electrically connected to the VFD. During an interruption in the utility power, the switch-mode power supply is configured to utilize DC electrical power generated by a back electromotive force of the permanent magnet motor to operate the backup gas supply to provide a flow of compressed working fluid to the one or more gas bearings.

In an embodiment, the compressor includes a controller. The controller has a utility power mode and a backup power supply mode. In the utility power mode, the VFD receives the utility power and supplies power to the permanent magnet motor to rotate the driveshaft and compress the working fluid. In the backup power supply mode, the VFD generates the DC electrical power utilizing the back electromotive force of the permanent magnet motor, and the DC electrical power is used to power the controller to activate the backup gas supply.

In an embodiment, in the backup power supply mode, the controller operates a backup compressed gas source utilizing electrical power supplied from the switch-mode power supply utilizing the DC electrical power.

In an embodiment, the DC electrical power is supplied from the VFD to the switch-mode power supply.

In an embodiment, the back electromotive force causes the permanent magnet motor to supply an AC electrical power to the VFD, and the VFD converts the AC electrical power into the DC electrical power.

In an embodiment, the electromotive force generates the DC electrical power in the VFD, and the DC electrical power is supplied from the VFD to the switch-mode power supply.

In an embodiment, the compressor includes a controller. The switch-mode power supply is configured to supply electrical power to the controller with a lower voltage than the DC electrical power.

In an embodiment, the switch-mode power supply receives the DC electrical power generated by the electromotive force at a first voltage and the DC electrical supplied from the switch-mode power supply to the controller is at a second voltage lower than the first voltage.

In an embodiment, the backup compressed gas source includes a second compressor. The second compressor is configured to operate by being powered by the switch-mode power utilizing the DC electrical power generated by the back electromotive force of the permanent magnet motor.

In an embodiment, the VFD includes an inverter electrically connected to the permanent magnet motor. The electromotive force of the permanent magnet motor generates AC electrical power that is supplied from the permanent magnet motor to the inverter of the VFD. The inverter is configured to convert the AC electrical power into the DC electrical power.

In an embodiment, the VFD includes a rectifier, a DC link, and an inverter in series. The rectifier is configured to receive utility power. The switch-mode power supply is electrically connected to the VFD between the DC link and the inverter.

In an embodiment, a method directed to operating an electric power supply system for a compressor in a heat transfer circuit. The compressor includes a permanent magnet electric motor, a driveshaft, and one or more gas bearing for supporting the driveshaft. The method includes operating the electrical power supply system in a utility power mode and operating the operating the electrical power supply system in backup power mode during an interruption of utility power. Operating in the utility power mode includes a VFD receiving utility power, supplying AC electrical power from the VFD to the electric motor to rotate the driveshaft and compress working fluid, and providing a flow of the compressed working fluid to the one or more gas bearings. Operating in the backup power mode during an interruption of the utility power includes supplying to a switch-mode power supply DC electrical power generated in the VFD by an electromotive force of the permanent magnet motor, and utilizing, via the switch-mode power supply, the DC electrical power generated by the electromotive force to operate a backup gas supply. The operation of the backup gas supply provides a flow of compressed working fluid to the one or more gas bearings.

In an embodiment, supplying the DC electrical power to the switch-mode power supply includes the back electromotive force causing the permanent magnet motor to supply AC electrical power to the VFD, and the VFD converting the AC electrical power into the DC electrical power.

In an embodiment, utilizing the DC electrical power generated by the electromotive force includes: the switch-mode power supply receiving the DC electrical power generated by an electromotive force at a first voltage, and the switch-mode power supply supplying DC electrical power at a second voltage lower than the first voltage.

In an embodiment, utilizing the DC electrical power generated by the electromotive force to operate the backup gas supply to operate the backup gas supply includes: converting, with the switch-mode power supply, the DC electrical power into electrical power with a lower voltage, and utilizing the electrical power with the lower voltage to operate the backup gas supply.

In an embodiment, the backup compressed gas source includes a second compressor. In the backup power mode, the second compressor is configured to be powered by the switch-mode power supply to supply the flow of the compressed working fluid to the one or more gas bearings.

In an embodiment, the VFD includes an inverter electrically connected to the permanent magnet motor. Supplying the DC electrical power generated to the switch-mode power supply includes: generating, by the electromotive force of the permanent magnet motor, AC electrical power that is supplied from the permanent magnet motor to the inverter of the VFD, and the inverter converting the AC electrical power into the DC electrical power.

In an embodiment, operating the electrical power supply system in the backup power mode includes initiating a shutdown of the compressor.

BRIEF DESCRIPTION OF THE DRAWINGS

Both described and other features, aspects, and advantages of a compressor for a heat transfer circuit, an electric power supply system for a heat transfer circuit, a method of operating an electric power supply system for a heat transfer circuit will be better understood with the following drawings:

FIG. 4 is a block flow diagram of a method of controlling an electrical power supply system for a heat transfer circuit.

DETAILED DESCRIPTION

A heating, ventilation, air conditioning, and refrigeration ("HVACR") system is generally configured to heat and/or cool an enclosed space (e.g., an interior space of a commercial or residential building, an interior space of a refrigerated transport unit, or the like). The HVACR system includes a heat transfer circuit that includes a compressor and a working fluid (e.g., a refrigerant, a refrigerant mixture, or the like) that circulates through the heat transfer circuit. The working fluid is utilized to heat or cool a process fluid (e.g., air, water and/or glycol, or the like).

The compressor includes a driveshaft, a motor that when powered rotates the driveshaft to compress the working fluid, and gas bearing(s) that support the driveshaft while it rotates. A gas bearing can be an aerostatic type of gas bearing. An aerostatic gas bearing relies upon the incoming flow of compressed gas to maintain the levitation of the driveshaft. When not provided with compressed gas, an aerostatic bearing is unable to keep the driveshaft levitated. The aerostatic gas bearing without the incoming compressed gas cannot maintain the layer of pressurized gas that prevents solid contact between the driveshaft and the aerostatic gas bearing. When compressed gas is no longer flowing to an aerostatic gas bearing, it can cause damage to the driveshaft and/or the gas bearing(s) due to the rotating driveshaft directly contacting the aerostatic gas bearing(s). An interruption in the utility power to the compressor can interrupt the operation of the compressor and the flow of the compressed gas to the gas bearing(s) resulting in damage to compressor. For example, a portion of the working fluid compressed by the compressor is supplied to the gas bearing(s), which means an interruption in the power to the compressor also interrupts the flow of compressed working fluid to the gas bearing(s). In some conventional configurations, a battery in the form of an uninterruptable power supply or the like, can be used to ensure that the compressor keeps compressing working fluid and supplying the compressed working to the gas bearing(s). However, this increases both the cost and maintenance of the compressor.

Embodiments described herein are directed to compressors, HVACR systems, heat transfer circuits, and power electric power supply systems for a heat transfer circuit that utilize the back electromotive force of the permanent magnet motor of the compressor to power and operate a backup gas supply when the utility power is interrupted. The powered backup gas supply providing a flow of compressed working fluid to the gas bearing(s) during the utility power interruption.

Figure 1:
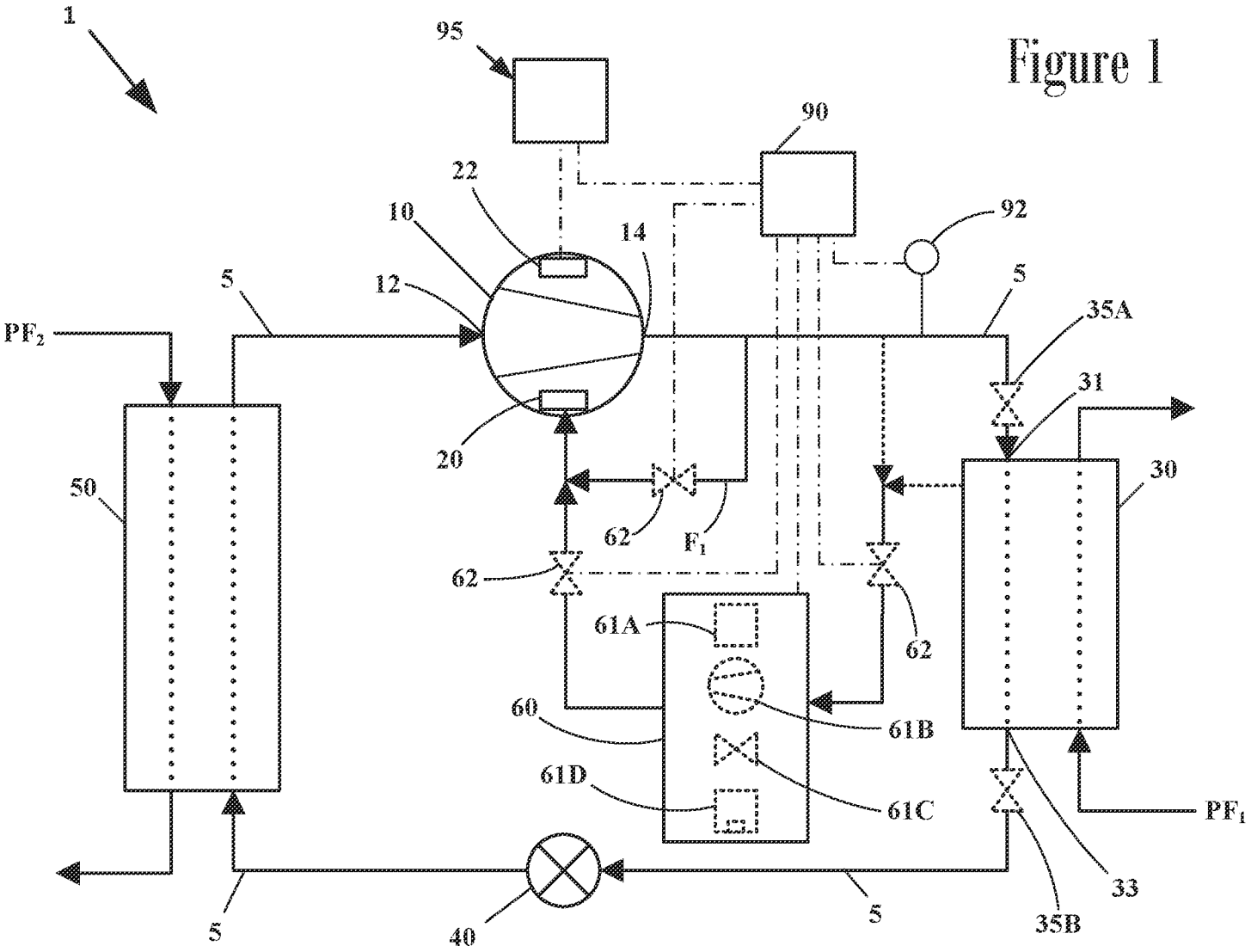
FIG. 1 is a schematic diagram of an embodiment of a heat transfer circuit 1.

FIG. 1 is a schematic diagram of an embodiment of a heat transfer circuit 1. In an embodiment, the heat transfer circuit 1 is utilized in a HVACR system. The heat transfer circuit 1 includes a compressor 10, a condenser 30, an expansion device 40, and an evaporator 50. In an embodiment, the heat transfer circuit 1 can be modified to include additional components, such as, for example, an economizer heat exchanger, one or more valve(s), sensor(s) (e.g., a flow sensor, a temperature sensor, and the like), a receiver tank, or the like.

The components of the heat transfer circuit 1 are fluidly connected. The heat transfer circuit 1 can be configured as a cooling system that can be operated in a cooling mode (e.g., a fluid chiller of an HVACR system, an air conditioning system, or the like), or the heat transfer circuit 1 may be configured as a heat pump system that can be run in a cooling mode or a heating mode.

A working fluid flows through the heat transfer circuit 1. The main flow path 5 of the working fluid through the heat transfer circuit 1 extends through the compressor 10, the condenser 30, the expansion device 40, the evaporator 50, and back to the compressor 10. In an embodiment, the main flow path 5 extends from a discharge outlet 14 of the compressor 10 back to a suction inlet 12 of the compressor 10, and through the compressor 10 from the suction inlet 12 to the discharge outlet 14. The working fluid in the main flow path 5 enters the compressor 10 through the suction inlet 12 and exits the compressor 10 through the discharge outlet 14. The working fluid includes one or more refrigerant(s).

Dotted lines are provided in the Figures to indicate fluid flows through some components (e.g., condenser 30, evaporator 50) for clarity, and should be understood as not specifying a specific route in each component. Dashed dotted lines are provided in FIG. 1 to illustrate electronic communications between different features. For example, a dashed dotted line extends from a controller 90 to a flow sensor 92 as the controller 90 receives measurements (e.g., flowrate measurements) from the flow sensor 92. For example, a dashed-dotted line extends from the controller 90 to the compressor 10 as the controller 90 controls the compressor 10. In an embodiment, the controller 90 includes memory for storing information and a processor. The controller 90 in FIG. 1 and described below is described/shown as a single component. However, it should be appreciated that a "controller" as shown in FIG. 1 and described herein may include multiple discrete or interconnected components that include a memory and a processor in an embodiment. In an embodiment, the controller 90 may be disposed within the compressor 10 (e.g., the controller 90 being an integral compressor controller).

Working fluid in a lower pressure gaseous state or mostly gaseous state is drawn into the suction inlet 12 of the compressor 10. The working fluid is compressed as it flows through the compressor 10. The working fluid flows from the discharge outlet 14 of the compressor 10 through the main flow path 5 to the condenser 30.

A first process fluid $PF_1$ flows through the condenser 30 separate from the working fluid. The condenser 30 is a heat exchanger that allows the working fluid and the first process fluid $PF_1$ to be in a heat transfer relationship without physically mixing as they each flow through the condenser 30. As the working fluid flows through the condenser 30, the working fluid is cooled by the first process fluid $PF_1$. Accordingly, the first process fluid $PF_1$ is heated by the working fluid and exits the condenser 30 at a higher temperature relative to temperature at which it entered the condenser 30. In an embodiment, the first process fluid $PF_1$ may be air, water and/or glycol, or the like that is suitable for absorbing and transferring heat from the working fluid and the heat transfer circuit 1. For example, the first process fluid $PF_1$ may be ambient air circulated from an outside atmosphere, water to be heated as hot water, or any suitable fluid for transferring heat from the heat transfer circuit 1. The working fluid is cooled by the condenser 30 and becomes liquid or mostly liquid as it is cooled in the condenser 30.

The liquid/gaseous working fluid flows from the condenser 30 to the expansion device 40. The expansion device 40 allows the working fluid to expand. The expansion causes the working fluid to significantly decrease in temperature. An "expansion device" as described herein may also be referred to as an expander. In an embodiment, the expander may be an expansion valve, expansion plate, expansion vessel, orifice, or the like, or other such types of expansion mechanisms. It should be appreciated that the expander may be any type of expander used in the field for expanding a working fluid to cause the working fluid to decrease in temperature. The gaseous/liquid working fluid has a lower temperature after being expanded by the expansion device 40.

The lower temperature gaseous/liquid working fluid then flows from the expansion device 40 to and through the evaporator 50. A second process fluid $PF_2$ also flows through the evaporator 50 separately from the working fluid. The evaporator 50 is a heat exchanger that allows the working fluid and the second process fluid $PF_2$ to be in a heat transfer relationship within the evaporator 50 without physically mixing. As the working fluid and the second process fluid $PF_2$ flow through the evaporator 50, the working fluid absorbs heat from the second process fluid $PF_2$ which cools the second process fluid $PF_2$. Accordingly, the second process fluid $PF_2$ exits the evaporator 50 at a lower temperature than the temperature at which it entered the evaporator 50. The working fluid is gaseous or mostly gaseous as it exits the evaporator 50. The working fluid flows from the evaporator 50 to the suction inlet 12 of the compressor 10.

In an embodiment, the second process fluid $PF_2$ is air cooled by the HVACR system and ventilated to the enclosed space to be conditioned. In an embodiment, the second process fluid $PF_2$ is an intermediate fluid (e.g., water, heat transfer fluid, or the like), and the cooled second process fluid $PF_2$ may be utilized by the HVACR system to cool air in or ventilated to the enclosed space to be conditioned.

The compressor 10 includes one or more gas bearing(s) 20. The gas bearing(s) 20 are aerostatic gas bearing(s) that provide support by utilizing an incoming flow of fluid. For example, a flow of the compressed working fluid $F_1$ is supplied to the gas bearing(s) 20 (e.g., the compressed working fluid discharged from the compressor 10 before passing through the expander 40, the working fluid in the main flow path 5 after the compressor 10 and before the expander 40). The gas bearing(s) 20 include one or more radial gas bearing(s) that radially support the driveshaft of the compressor 10 while it rotates. The heat transfer circuit 1 includes a backup gas supply 60 configured to supply compressed working fluid to the gas bearing(s) 20 when compressor 10 is unable to supply sufficient compressed working fluid for gas bearing(s) 20. For example, the backup gas supply 60 is used during a utility power interruption that stops the operation of the compressor 10.

In an embodiment, the backup gas supply 60 may be a vessel 61A which has been charged with compressed gaseous working fluid during normal operation of the compressor 10. An outlet valve (e.g., the valve 62 between the backup gas supply 60 and gas bearing(s) 20) can be used to open and control discharge of the compressed gaseous working fluid from the vessel 61A to the gas bearing(s).

In an embodiment, the backup gas supply 60 may include a second compressor 61B smaller than the compressor 10 which is operable to provide compressed gaseous working fluid to the gas bearing(s) 20. In an embodiment, the backup gas supply 60 may include a pump for pumping compressed working fluid (e.g., liquid working fluid) to the gas bearing(s) 20.

In an embodiment, the backup gas supply 60 may include a condenser valve 61C that fluidly connects the condenser 30 to the compressor bearing(s) 20. For example, the condenser valve 61C fluidly connects to the condenser 30 between its inlet 31 and its outlet 33. The opened condenser valve 61C is configured to supply pressurized working fluid within the condenser 30 to the gas bearing(s) 20. In such an embodiment, the controller 90 upon sensing a utility power interruption can be configured to close valve(s) in the main flow path 5 to prevent depletion of the pressurized working fluid from the condenser 30 until supplied to the gas bearing(s) 20 (e.g., closing a valve 35A to stop flow through the inlet 31 of the condenser 30, closing a valve 35B to stop flow through the outlet 33 of the condenser 30 to the expander 40 and/or the expander 40 being an electronic expansion valve that is closed to stop flow from the outlet 33 through the expander 40, or the like).

In an embodiment, the backup gas supply may include a vessel with an electric heater 61D that is charged with liquid or a mixture of liquid and gaseous working fluid (e.g., charged with the liquid and/or gaseous working fluid from the condenser 30, or the like). The heater is powered to heat/vaporize the liquid within the vessel and provide compressed working fluid to the gas bearing(s) 20. The vessel with an electric heater 61D may be charged with working fluid during normal operation.

In an embodiment, to conserve power during a utility power interruption, the backup gas supply 60 may include the condenser valve 61C in combination with the second compressor 61B or the vessel with a heater 61D. For example, the controller 90 configured to supply pressurized working fluid to the gas bearing(s) 20 by using the available compressed gas within the condenser 30, and then powering a second compressor or a vessel with an electric heater 61D to generate the compressed working fluid (e.g., compressed gas). The controller 90 powers the second compressor 61B or the electric heater of the vessel with the electric heater 61D to generate compressed working fluid once the pressurized gaseous working fluid stored in the condenser 30 is consumed (e.g., gaseous working fluid stored in the condenser 30 is no longer at a sufficient pressure for operating the gas bearing(s) 20).

One or more valve(s) 62 (e.g., outlet valve, flow control valve, check valve, or the like) can be utilized to ensure that the compressed gaseous work fluid discharged from backup gas supply 60 flows to the gas bearing(s) 20.

In an embodiment, the backup gas supply 60 may be used to supply pressurized working fluid to the gas bearing(s) 20 during startup and/or shutdown of the compressor 10. For example, during the startup of the compressor 10, the controller 90 operates the backup gas supply 60 to supply compressed working fluid from the backup gas supply 60 to the gas bearing(s) 20 until the gas discharged from the outlet 14 of the compressor 10 is at a predetermined pressure (e.g., at a pressure sufficient for the gas bearing(s) to levitate the driveshaft of the compressor 10).

The heat transfer circuit 1 includes an electrical power supply system 95. The electrical power supply system 95 is configured to supply for supplying electrical power to the electrical components for operating the heat transfer circuit 1. For example, the electrical components for operating the heat transfer circuit can include, but not limited to, a motor 22 of the compressor 10, the valve(s) 62, the controller 90, fan(s), sensor(s), and the like). For simplicity, "power" as described hereafter refers to "electrical power" unless specified otherwise.

Figure 2:
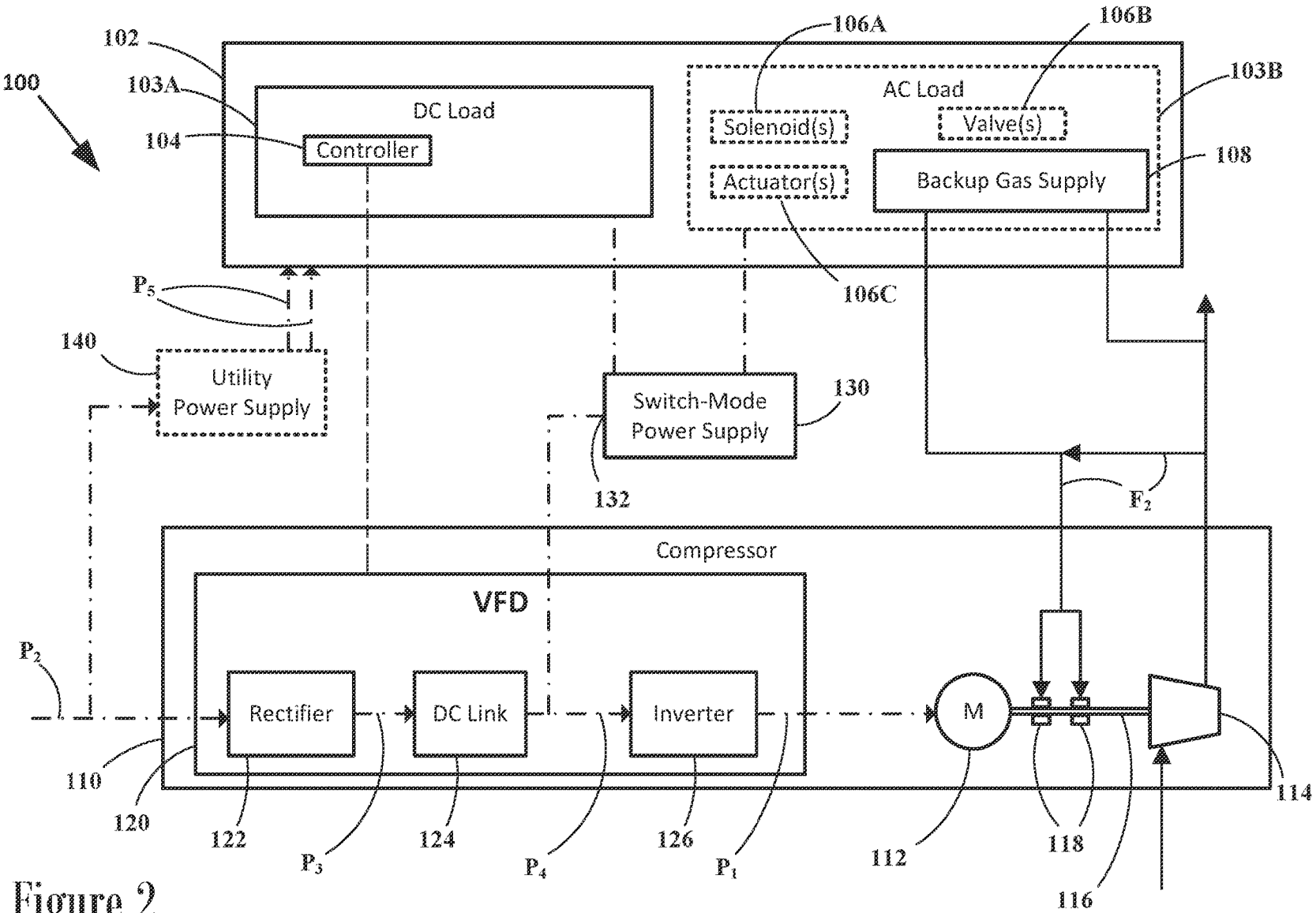
FIG. 2 is a block diagram of an electrical power system for a heat transfer circuit, when operating in a utility power mode.

FIG. 2 is block diagram of an electrical power supply system 100 for a compressor of a heat transfer circuit. For example, the electrical power system 100 may be the electrical power system 95 in FIG. 1. The heat transfer circuit includes a compressor 110 that compresses the working fluid that flows flow through the heat transfer circuit. The dashed-dotted arrows in FIG. 2 indicate the flow of electricity when utility power $P_2$ is flowing and is being supplied to the electrical power system 100. For example, the compressor 110 in FIG. 2 is being powered using utility power $P_2$. This can be referred to as a "utility power mode" or a "normal operation" of the electrical power system 100. FIG. 2 illustrates the electrical power system 100 in the utility power mode. The electrical power system 100 supplies/provides electrical power to the electrical components of the heat transfer circuit.

The compressor 110 includes an electric motor 112, a compression mechanism 114 (e.g., intermeshed screw, scroll, impeller, or the like), a driveshaft 116, gas bearing(s) 118 (e.g., gas bearings 20 in FIG. 1, or the like), and a variable frequency drive ("VFD") 120. The electrical power system 100 includes the VFD 120. The compression mechanism 114 is mounted to the driveshaft 116. The electrical power system 100 powers the motor 112 by the VFD 120 supplying AC power $P_1$ to the motor 112. The electric motor 112 operates using known principles to rotate the driveshaft 116. The AC power $P_1$ powers the motor 112 to rotate the driveshaft 116 which rotates/orbits the affixed compression mechanism 114 to compress the working fluid. In an embodiment, the AC power $P_1$ supplied by the inverter 126 is multiphase AC power (e.g., three-phase AC power, or the like). The AC power $P_1$ supplied from the VFD 120 to the motor 112 can also be referred to as motor input power. The controller 104 controls the VFD 120 and adjusts the speed of the motor 112 by controlling the frequency of the motor input power $P_1$ supplied by the VFD 120 to the motor 112. The use of the VFD 120 allows the motor 112 to be a variable speed motor.

The rotating driveshaft 116 is supported by the gas bearing(s) 118. The gas bearing(s) 118 are aerostatic gas bearing(s) that provide support by utilizing an incoming flow of compressed gas $F_2$. An aerostatic gas bearing relies upon the incoming flow of compressed gas to maintain the levitation of the driveshaft. The aerostatic bearing is unable to keep the driveshaft levitated when not being supplied with the flow of compressed gas (e.g., the aerostatic gas bearing without the incoming compressed gas cannot maintain the layer of pressurized gas that prevents solid contact between the driveshaft and the aerostatic gas bearing). As shown in FIG. 2, in the utility power mode, the flow of compressed gas $F_2$ supplied to the gas bearing(s) 118 is a portion of the working fluid compressed by the compressor 110.

Generally, utility power $P_2$ is supplied to the electrical power system 100. In an embodiment, the utility power $P_2$ is multiphase AC electrical power (e.g., three-phase AC electrical power, or the like). The utility power $P_2$ is used by the electrical power system 100 to supply electrical power to each electrical component of the heat transfer circuit at its specified type and voltage (e.g., 24V DC, 120V AC, and the like). The VFD 120 receives utility power $P_2$ and converts the utility power $P_2$ into the motor input power $P_1$. In an embodiment, the voltage of the utility power $P_2$ is about 690V or less.

In an embodiment, the VFD 120 includes a rectifier 122, a DC link 124, and an inverter 126. The rectifier 122, DC link 124, and the inverter 126 are electrically connected in series in the VFD 120. For example, the DC link 124 electrically connects the output of the rectifier 122 to the input of the inverter 126. The rectifier 122, DC link 124, and inverter 126 converts the utility power $P_1$ into the motor input power $P_1$. The rectifier 122 of the VFD 120 receives the utility power $P_2$. The rectifier 122 converts the AC three-phase power $P_2$ into DC power $P_3$ which is supplied to the DC link 124. The DC link 124 filters/smooths the voltage of DC power $P_3$ received from the rectifier 122 and outputs filtered DC power $P_4$. The filtered DC power $P_4$ is supplied from the DC link 124 to the inverter 126. The filtered DC power $P_4$ supplied to the inverter 126 is converted by the inverter 126 into the AC motor input power $P_1$ which is supplied from VFD to the motor 112. The inverter 126 of the VFD 120 supplies the motor input power $P_1$ to motor 112.

The electrical power system 100 includes a switch-mode power supply 130 that is electrically connected to the VFD 120. The switch-mode power supply 130 is electrically connected between the rectifier 122 and the inverter 126. In the illustrated embodiment, the switch-mode power supply 130 is electrically connected after the rectifier 122 and before the inverter 126 within the VFD 120. For example, the inlet 132 of the switch-mode power supply 130 is connected after the rectifier 122 and before the inverter 126 within the VFD 120. In another embodiment, the switch-mode power supply 130 may be electrically connected after the rectifier 122 and before the DC link 124. For example, the inlet 132 of the switch-mode power supply 130 is connected after the rectifier 122 and before the DC link 124 within the VFD 120.

The HVACR system can include other various electrical components used in operating the heat transfer circuit. An electrical power load 102 is the electrical power consumed in the activating/operating of the other electrical components. Examples of such electrical components can include, but not limited to, controller 104 (e.g., controller 90 in FIG. 1, or the like), solenoid(s) 106A, valve(s) 106B (e.g., valve(s) 62, or the like), actuators 106C, a backup gas supply 108 (e.g., backup gas supply 60 in FIG. 1, or the like), fan(s) (e.g., evaporator fan, condenser fan, etc.), and/or sensor(s) (e.g., temperature sensor(s), pressure sensor(s), and the like). It should be appreciated the electrical power load 102 can vary based on the how the heat transfer circuit is operating (e.g., operating at maximum capacity, operating a minimum capacity, operating in a defrost mode, operating in a ventilation mode, and the like). The electrical power system 100 supplies power $P_5$ to meet the electrical load 102 of the other electrical components.

In the illustrated embodiment, the electrical power system 100 includes a utility power supply 140. The utility power supply 140 receives utility power $P_2$ and supplies power $P_5$ to power the other electrical components for operating the heat transfer circuit. The utility power supply 140 supplies power $P_5$ that meets the electrical load 102. The utility power supply 140 can supply electrical power for each electrical component of the heat transfer circuit at its specified type and voltage. In an embodiment, the power $P_5$ supplied by utility power supply 140 can include DC power (e.g., 24V DC power, or the like) for the DC powered electrical components and/or AC power (e.g., 120V AC power, or the like) for the AC powered electrical components. In another embodiment, the switch-mode power supply 130 may be configured to supply the power $P_5$ for the electrical load 102 in the utility power mode. In such a configuration, the electrical power system 100 may not include the utility power supply 140 (e.g., the utility power supply 140 being incorporated into the switch-mode power supply 130, etc.) The switch-mode power supply 130 can be configured to utilize the utility power $P_2$ directly (e.g., the switch-mode power supply 130 receives the utility power $P_2$) or indirectly via the VFD 120 (e.g., the switch-mode power supply 130 receiving the DC electrical power from DC link 124).

In some instances, the flow of utility power $P_2$ to the electrical power system 100 can be interrupted (e.g., a building power outage, a utility transmission line outage, a power plant outage, and the like). The electrical power system 100 is configured to operate in a backup power mode when the utility power $P_2$ is interrupted. For example, the electrical power system 100 starts operating in the backup power mode when the electrical power system 100 unexpectedly stops receiving utility power $P_2$. In the backup power mode, utility power is not being supplied to the electrical power system 100.

Figure 3:
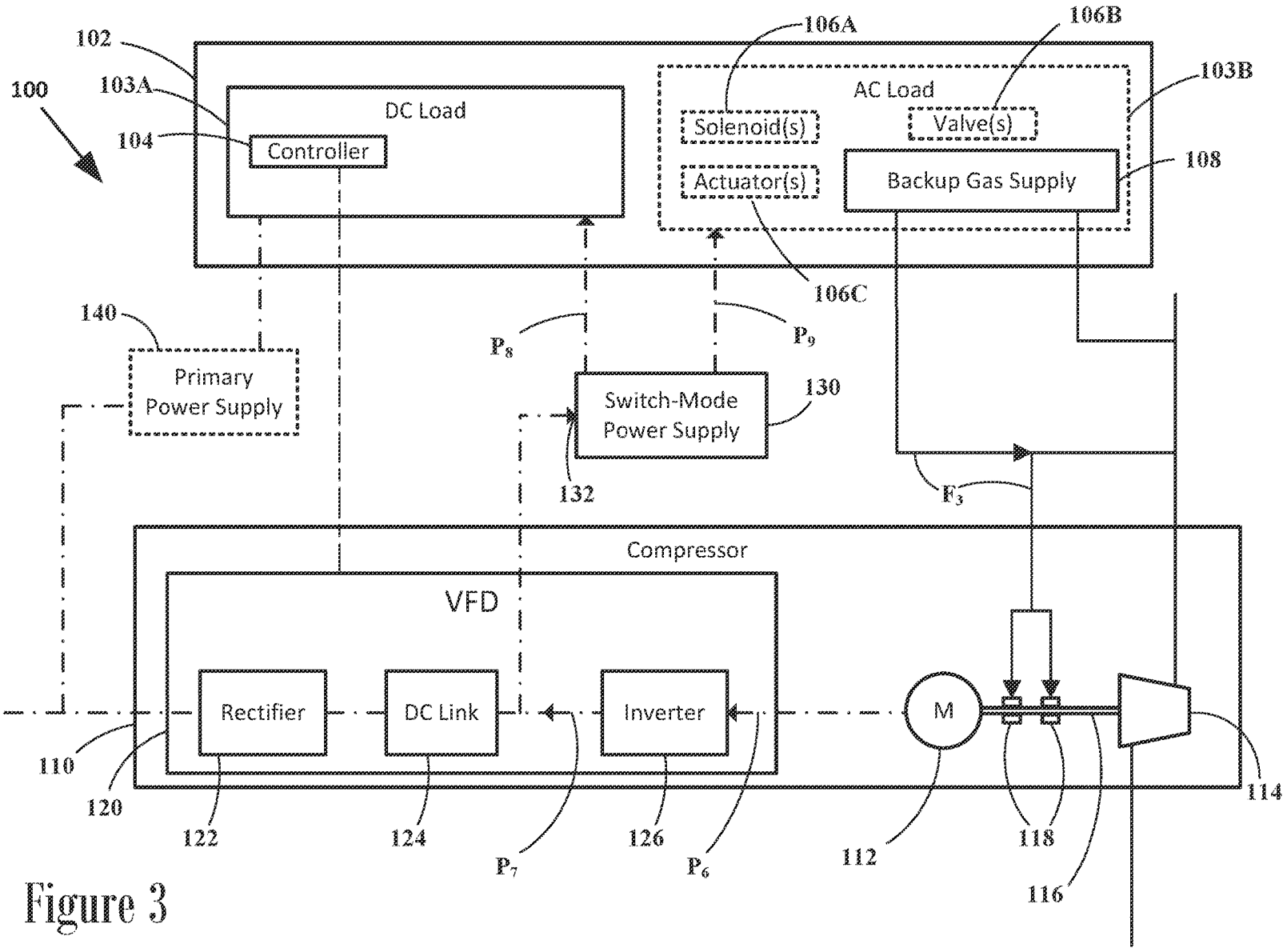
FIG. 3 is a block diagram of the electrical power system in FIG. 2, when operating in a backup power mode.

FIG. 3 illustrates the electrical power supply system 100 when operating in the backup power mode. The backup power mode does not utilize a battery backup (e.g., an uninterrupted power supply, or the like). When the utility power is interrupted, the VFD 120 stops powering the permanent magnet motor 112 (e.g., no power is being supplied from the VFD 120 to the motor 112). When electrical power is suddenly no longer being provided to supplied to the motor 112, the back electromotive force from the permanent magnet motor 112 causes the permanent magnet motor 112 to generate and supply electrical power $P_6$ to the VFD 120. The back electromotive force results from the interaction of the still rotating driveshaft 116 (e.g., the still rotating rotor affixed to the driveshaft 116) and the motor 112. For example, the back electromotive force causes the permanent magnetic motor 112 to temporary operate as an electrical generator. The voltage of the electrical power $P_6$ generated via the electromotive force varies with the speed of the still rotating driveshaft 116. The amount of electrical power $P_6$ decreases as the speed/rotation of the driveshaft 116 slows down. For example, the voltage of the electrical power $P_6$ generated by the motor 112 is at a maximum voltage when a utility power interruption occurs and then decreases as the rotation of the driveshaft 116 slows down.

The inverter 126 is configured to convert DC electrical power into AC electrical power in the forward direction (e.g., convert DC electrical power into three-phase AC electrical power during normal operation) and to convert AC electrical power into DC electrical power in the reverse direction (convert the multiphase AC electrical power into DC electrical power during the backup power mode). For example, the motor supplies the multiphase AC power $P_6$ (e.g., three-phase AC power, or the like) to the inverter 126 which converts the multiphase AC power $P_6$ into DC power $P_7$. The voltage of the DC power $P_7$ generated in the VFD 120 from the back electromotive force of the motor 112 is at least 200V. In an embodiment, the voltage of the DC power $P_7$ is at least 400V. In an embodiment, the voltage of the DC power $P_7$ is at least 600V. For example, the voltage of the DC power $P_7$ may be at or about 650V.

In the backup power mode, the switch-mode power supply 130 utilizes the DC power $P_7$ generated in the VFD 120 from the motor 112. The switch-mode power supply 130 is electrically connected to the VFD 120 such the VFD 120 supplies the generated DC power $P_7$ to the switch-mode power supply. The DC power $P_7$ is supplied from the inverter 126 to the switch-mode power supply 130. The switch-mode power supply 130 utilizes the DC power $P_7$ to supply power $P_8$, $P_9$ to electrical components used for operating the heat transfer circuit. In particular, the DC power $P_7$ generated by motor 112 and inverter 126 has a voltage that is higher than the voltage used by the electrical components for controller operation of the compressor 110. For example, the DC power $P_7$ can have a voltage over 600V while the electrical components use voltage(s) that below 150V. The switch-mode power supply 130 is configured to convert the DC power $P_7$ to electrical power with a lower voltage (e.g., a voltage reduction of at least 60%). The higher and lower voltage may be significantly different. In an embodiment, the switch-mode power supply 130 converts the DC electrical power $P_7$ to DC electrical power $P_8$ (e.g., 24V DC electrical power, or the like). In some embodiments, the switch-mode power supply 130 converts the DC electrical power $P_7$ to the DC electrical power $P_8$ and AC electrical power $P_9$ (e.g., 120V AC electrical power, or the like).

The electrical load 102 can include a DC load 103A and/or an AC load 130B. In an embodiment, the DC load 103A is for powering DC powered component(s) used in controlling operation of the compressor 110. In an embodiment, the AC load 103B is for powering AC powered component(s) used in controlling operation of the compressor 110. For example, the DC load 103A and/or the AC load 103B may be limited to only electrical component(s) that are critical for compressor control to conserve the limited amount of electrical power $P_6$ available from the motor 112. The switch-mode power supply 130 supplies DC power $P_8$ to power the DC load 103A and/or AC power $P_9$ to power the AC load 103B.

In particular, the switch-mode power supply 130 supplies electrical power $P_8$, $P_9$ to activate/operate the backup gas supply 108 to provide a flow of compressed gas $F_3$ to the gas bearing(s) 118 of the compressor 110. For example, the switch-mode power supply 130 provides DC power $P_8$ to power the controller 104. The controller 104 is configured to active/operate the backup gas supply 108. For example, the switch-mode power supply 130 provides AC power $P_9$ for activating/operating the backup gas supply 108.

In another embodiment, the backup gas supply 108 includes a vessel (e.g., vessel 61A in FIG. 1, or the like) containing compressed working fluid. The vessel is charged with compressed gaseous working fluid during normal operation of the compressor 110. In such an embodiment, the valve(s) 106B can include a flow control valve for controlling the flow output of the vessel. When a power interruption occurs, the switch-mode power supply 130 provides electrical power $P_8$, $P_9$ sufficient for operating the vessel to provide compressed working fluid $F_3$ to gas bearing(s) 118. For example, the switch-mode power supply 130 supplies electrical power $P_8$, $P_9$ to power the controller 104 and the flow control valve for the vessel. The controller 104 detects that a utility power interruption is occurring and opens the flow control valve to supply the compressed working fluid $F_3$ to the gas bearings 118. In some embodiments, the controller 104 may also activate one or more of the other valve(s) 106B (e.g., valves 62 in FIG. 1, or the like) so that the compressed working fluid $F_3$ correctly flows from the vessel to the gas bearing(s) 118 (e.g., flows from the backup gas supply 108 to the gas bearing(s) 118).

In one embodiment, the backup gas supply 108 includes a second compressor (e.g., second compressor 61B in FIG. 1, or the like) that compresses working fluid and provides the compressed working fluid to the gas bearing(s) 118 during the backup power supply mode. The second compressor of the backup gas supply 108 being smaller than the main compressor 110. When a power interruption occurs, the switch-mode power supply 130 provides electrical power $P_8$, $P_9$ to power the second compressor to provide a flow of compressed working fluid $F_3$ to the gas bearing(s) 118. For example, the switch-mode power supply 130 supplies DC electrical power $P_8$ to power the controller 104 and AC electrical power $P_9$ for powering the second compressor (e.g., for operating the motor of the second compressor). The controller 104 detects that a utility power interruption is occurring and activates the second compressor to begin compressing working fluid and provide the flow of compressed working fluid $F_3$ to the gas bearings 118. In some embodiments, the controller 104 also activates one or more of the valve(s) 106B (e.g., valves 62 in FIG. 1, or the like) so that the compressed working fluid $F_3$ correctly flows from the second compressor to the gas bearing(s) 118 (e.g., flows from the backup gas supply 108 to the gas bearing(s) 118 in FIG. 3, doesn't flow into the outlet of the compressor 110, doesn't flow into the condenser, or the like).

In another embodiment, the backup gas supply 108 include a vessel with a heater (e.g., vessel with a heater 61D in FIG. 1, or the like) for containing liquid and/or gaseous working fluid. The vessel can be charged with liquid and/or gaseous working fluid during normal operation of the compressor 110. In such an embodiment, the valve(s) 106B may include a flow control valve for controlling the flow output of the vessel. When a power interruption occurs, the switch-mode power supply 130 provides electrical power $P_8$, $P_9$ sufficient for operating the vessel and its heater to provide compressed working fluid $F_3$ to the gas bearing(s) 118. For example, the switch-mode power supply 130 supplies electrical power $P_8$, $P_9$ to power the controller 104, to power the heater, and to power the flow control valve for the vessel. The heater heats the liquid and/or gaseous working fluid within the vessel to generate compressed working fluid within the vessel. For example, the powered heater vaporizes liquid working fluid in the vessel to generate compressed gaseous working fluid within the vessel which is then supplied to the gas bearing(s) 118). The controller 104 detects that a utility power interruption is occurring, turns on the heater to generate the compressed working fluid within the vessel, and opens the flow control valve to supply the generated compressed working fluid $F_3$ from the vessel to the gas bearings 118. In some embodiments, the controller 104 may also activate one or more of the other valve(s) 106B (e.g., valves 62 in FIG. 1, or the like) so that the compressed working fluid $F_3$ correctly flows from the vessel to the gas bearing(s) 180 (e.g., flows from the backup gas supply 108 to the gas bearing(s) 118). In an embodiment, the backup gas supply 108 may include a condenser valve (e.g., condenser valve 61C in FIG. 1, or the like) that fluidly connects a condenser of the heat transfer circuit (e.g., condenser 30 in FIG. 1, or the like) to the gas bearing(s) 118. When a power interruption occurs, the switch-mode power supply 130 provides electrical power $P_8$, $P_9$ sufficient for the controller 104 to activate the condenser valve (e.g., open/operate the condenser valve) to supply compressed working fluid $F_3$ to the gas bearing(s) 118. The condenser valve of the backup gas supply 108 supplies a flow of compressed working fluid contained in the condenser to the gas bearing(s) 118. In some embodiments, when a power interruption occurs, the controller 104 can also be configured to close valve(s) in the main flow path of the heat transfer circuit (e.g., main flow path 5 in FIG. 1, or the like) to prevent depletion of the pressurized working fluid from the condenser 30 until supplied to the gas bearing(s) 118 (e.g., close valve 35A, close valve 35B, the expander 40 being an electronic expansion valve that is closed to stop flow from the outlet 33 through the expander 40, or the like).

In an embodiment, to conserve power during a utility power interruption, the backup gas supply 108 may include the condenser valve or the charged vessel in combination with the second compressor or the vessel with a heater. For example, the controller 104 configured to supply pressurized working fluid to the gas bearing(s) 118 by using the available compressed gas within the condenser and/or the charged vessel, and then powering a second compressor 61B and/or a vessel with an electric heater to generate the additional compressed working fluid (e.g., compressed gas). The controller 104 is configured to operate the second compressor and/or the electric heater to generate compressed working fluid once the pressurized gaseous working fluid stored in the condenser is consumed (e.g., gaseous working fluid stored in the condenser 30 is no longer at a sufficient pressure for operating the gas bearing(s) 20 in FIG. 1, the gaseous working fluid in the condenser is less than a predetermined pressure).

In the backup power mode, the backup gas supply 108 is powered and operates to supply the flow of compressed working fluid $F_3$ to the gas bearing(s) 118 of the compressor 110. The electrical power system 100 is configured so as to maintain the flow of compressed gas to the gas bearing(s) 118 when a utility power interruption occurs. This advantageously allows the rotating driveshaft 116 to slow down/stop before contacting the gas bearing(s) 118, or the gas bearing(s) 118 to maintain their support/levitation of the driveshaft 116 by the gas bearing(s) 118 during a short utility power interruption.

FIG. 4 is a block flow diagram of a method 1000 of controlling an electrical power supply system of a heat transfer circuit. In an embodiment, the method 1000 may be applied to the electrical power supply system 95 of the heat transfer circuit 1 in FIG. 1 and/or the electrical power supply system 100 in FIGS. 2 and 3. The method 1000 begins at 1100.

At 1100, the electrical power system operates in a utility power mode. For example, the electrical power system 100 in FIG. 2 is operating in the utility power mode. The utility power mode utilizes utility power (e.g., utility power $P_2$) to electrically power the electrical components of the heat transfer circuit. As shown in FIG. 4, operating in the utility power mode 1110 includes 1102-1108 for operation of a compressor of the heat transfer circuit (e.g., compressor 10, compressor 110).

At 1102, the utility power is received by a variable frequency drive (VFD) of the compressor (e.g., VFD 120). At 1104, the VFD uses the utility power to supply the electrical power (e.g., electrical power $P_1$) to an electric motor of the compressor (e.g., electric motor 22, electric motor 112). As discussed above, the VFD can include a rectifier (e.g., rectifier 122), DC link (e.g., DC link 124), and an inverter (e.g., inverter 126) in series to convert the utility power to the electrical power supplied to the motor. At 1106, the electric motor is powered by the supplied electrical power from the VFD. The powered electric motor rotates a driveshaft (e.g. driveshaft 116) to compress the working fluid in the heat transfer circuit. In particular, the driveshaft is affixed to a compression mechanism (e.g., compression mechanism 114) and the rotating of the driveshaft moves the coupled compression mechanism to compress the working fluid. At 1108, a flow of the compressed working fluid (e.g., flow of compressed working fluid $F_1$, flow of compressed working fluid $F_2$) is provided to the gas bearing(s) of the compressor (e.g., gas bearing gas bearing(s) 118). A portion of the compressed working fluid is supplied to the gas bearing(s). The gas bearing(s) utilize the compressed working fluid to support the rotating driveshaft.

Operating in the utility power mode 1100 can also include a power supply (e.g., utility power supply 140, switch-mode power supply 130) supplying electrical power (e.g., electrical power $P_5$) to other electrical components of the heat transfer circuit 1110. For example, supplying electrical power to other electrical components 1110 can include the power supply (e.g., utility power supply 140) receiving the utility power (e.g., utility power $P_2$) and supplying DC electrical power and/or the AC electrical power to meet the electrical load of the other electrical components (e.g., electrical load 102). For example, supplying electrical power to the other electrical components 1110 can include the power supply (e.g., switch-mode power supply 130) receiving DC electrical power generated by the VFD (e.g., the DC electrical power supplied from the DC Link 124) and supplying the DC electrical power and/or the AC electrical power to meet the electrical load of the other electrical component(s). The method 1000 then proceeds to 1200.

At 1200, the electrical power system operates in a backup power mode. For example, the electrical power system 100 in FIG. 3 is operating in the backup power mode. The backup power mode occurs when the flow of utility power is interrupted. The electrical power system switches from the utility power mode to the backup power mode when the utility power is no longer being supplied to the electrical power system. The backup power mode utilizes electrical power generated by the back electromotive force of the motor (e.g., electrical power $P_5$) to electrically power electrical components of the heat transfer circuit. In particular, the backup power mode utilizes the back electromotive force generated electric power to ensure that the feed of compressed gas to the gas bearing(s) does not suddenly stop while the driveshaft is still rotating (e.g., prevents the power interruption from causing failure of the gas bearing(s) due to no longer being fed compressed gas).

Operating the electrical power system in the backup power mode 1200 includes 1210, 1220, 1230, and 1230. At 1210, DC electrical power generated in the VFD by the back electromotive force (e.g., DC electrical power $P_7$) is supplied to a switch-mode power supply (e.g., switch-mode power supply 130). Supplying the DC electrical power 1210 can include the inverter of the VFD receiving from the motor the AC electrical power generated by the motor's back electromotive force (e.g., electrical power $P_5$), and the inverter converting into the DC electrical power. The method 1200 then proceeds from 1210 to 1220.

At 1220, the DC electrical power supplied from the VFD to the switch-mode power supply is utilize to operate a backup gas supply (e.g., and provide compressed fluid to the gas bearing(s). Utilizing the DC electrical power to operate the backup gas supply at 1220 can include the switch-mode power supply supplying DC electrical power (e.g., DC electrical power $P_8$) to DC powered electrical component(s) of the heat transfer circuit 1222. In particular, the switch-mode power supply supplying the DC electrical power to DC powered electrical component(s) at 1222 includes supplying DC electrical power to a controller of the heat transfer circuit (e.g., controller 90, controller 104). The powered controller can activate the backup gas supply to begin the flow of the compressed fluid (e.g., compressed fluid $F_3$) from the backup gas supply to the gas bearing(s). In an embodiment, the backup gas supply can be a second smaller compressor, and the powered controller can initiate the startup of the second smaller compressor. In another embodiment, the backup gas supply can be a vessel containing compressed working fluid, and the powered controller can open an outlet valve for the vessel so the compressed working fluid flows from the vessel to the gas bearing(s).

Utilizing the DC electrical power to operate the backup gas supply 1220 can include the switch-mode power supply supplying AC electrical power (e.g., AC electrical power $P_9$) to AC powered electrical component(s) of the heat transfer circuit 1224. In particular, the switch mode power supply supplies AC electrical power 1224 to AC electrical components used for operating/activating the backup gas supply. For example, in an embodiment in which the backup gas supply is a second smaller compressor, supplying the AC electrical power at 1224 can include supplying the AC electrical power to the power the second smaller compressor (e.g., AC electrical power for powering the motor of the second smaller compressor). For example, in an embodiment in which the backup gas supply is a vessel containing compressed working fluid, supplying the AC electrical power at 1224 can include supplying the AC electrical power to power the valve(s) for directing the working fluid from the outlet of the vessel to the gas bearing(s) (e.g., valve(s) 62, valve(s) 106B). The method 1000 then proceeds to 1230.

At 1230, when the utility power is restored (e.g., the utility power flows to the electrical power supply system after being interrupted, the utility power interruption ends, etc.), the method 1000 returns to operating in the utility power mode at 1110. In returning to the utility power mode 1110, the method can include resetting any adjustments to the heat transfer circuit made by operating in the backup power mode. For example, shutting down the second smaller compressor used to supply compressed working fluid to the gas bearing(s) at 1220 in an embodiment. For example, opening and/or closing valves to recharge the vessel used to supply compressed working fluid to the gas bearing(s) at 1220 in another embodiment. If utility power is still interrupted, the method 1000 proceeds to 1240.

At 1240, the controller compares the length of the utility power interruption to a predetermined time period. If the utility power interruption is shorter than the predetermined time period, the method 1000 returns to 1220. For example, when the utility power interruption is shorter than the predetermined time period at 1240, the electrical power system continues its utilization of the back electromotive force generated electrical power to have the backup gas supply provide the flow of compressed gas to the gas bearing(s). If the utility power interruption is equal to or longer than the predetermined time period, then the method 1000 proceeds to 1250. The predetermined time period can be amount of time that indicates that a utility power interruption is a significant power outage (e.g., a building power outage, a utility transmission line outage, a power plant outage, etc.). The predetermined time period may be based on the amount of time the backup gas supply is able to supply compressed gas to the gas bearing(s) (e.g., length of time until the vessel is empty, length of time that the electromotive force generates power sufficient to power the second smaller compressor, or the like). At 1250, the controller initiates a shutdown of the compressor. The shutdown of the compressor at 1250 can include the shutdown of heat transfer circuit. In an embodiment, the shutdown of the compressor at 1250 includes the adjustments made during a normal shutdown of the compressor (e.g., closing the vanes of the compressor, closing a solenoid valve(s) in the heat transfer circuit to perform a pump down, etc.).

In an embodiment, the controller at 1240 may be configured to initiate the shutdown when the electrical power generated by the electromotive force (e.g., electrical power $P_6$ supplied from the motor 112, electrical power $P_7$ generated in the VFD 120) decreases to a predetermined amount (e.g., a predetermined voltage, or the like). For example, the controller initiates the shutdown of the compressor when the voltage of the electrical power generated by the electromotive force is at a predetermined voltage threshold (e.g., the voltage of the electrical power $P_6$, the voltage of the electrical power $P_7$, or the like). The electrical power system may include an electrical power sensor (e.g., a voltage sensor, a current sensor, or the like) that is utilized by the controller to detect the voltage of the electrical power generated by the electromotive force. The predetermined amount/voltage threshold can be based on the minimum amount of power needed for completing the shutdown of the compressor. In such an embodiment, 1240 in the illustrated embodiment of FIG. 4 may be replaced with comparing electrical power generated by the electromotive force (e.g., electrical power $P_6$ supplied from the motor 112, electrical power $P_7$ generated in the VFD 120) to a predetermined threshold (e.g., a predetermined voltage, or the like). For example, when the amount of electrical power generated by the electrical electromotive force (e.g., the present voltage of the electrical power $P_6$, the present voltage of the electrical power $P_7$, or the like) equal to or greater than a predetermined power threshold (e.g., a predetermined voltage threshold), the method 1000 goes back to 1220. For example, when the amount of electrical power generated by the electrical electromotive force is less than the predetermined power threshold, the method 1000 proceeds to 1250 at which the controller initiates the shutdown of the compressor.

The method 1000 can allow for the heat transfer circuit and the compressor to be shut down in a normal manner when an interruption in the utility power occurs unexpectedly without utilizing a battery backup, such as an uninterrupted power supply. This advantageously prevents the high speed rotating driveshaft from contacting and damaging the gas bearing(s) during an unexpected power outage. The method 1000 can advantageously provide for a faster restart time as the heat transfer circuit is in a known shutdown state (e.g., can startup from a known shutdown instead of a diagnostic startup to account for pressure(s) and component(s) being left in an unknown state).

It should be appreciated that the method 1000 in an embodiment may be modified based on the heat transfer circuit 1 as shown in FIG. 1 and/or the electrical power system 100 in FIGS. 2 and 3 and as discussed above.

It should be appreciated that that heat transfer circuit 1, the compressor for compressing working fluid in a heat transfer circuit (e.g., compressor 10, compressor 110), the electrical power supply system 100 for a compressor of a heat transfer circuit, and the method 1000 of controlling an electrical power supply system of a heat transfer circuit as described herein may be modified in other embodiments to be for a climate controlled transport unit. For example, in an embodiment, the utility power and the utility power mode as described above can instead be internal electrical power and an internal power mode. In the internal power mode, an internal power source of the climate controlled transport unit (e.g., an internal combustion engine and generator, a battery, or the like) supplies the electrical power to power the electrical components for the heat transfer circuit. For example, in an embodiment, an internal combustion engine (e.g., diesel engine, or the like) can drive a generator which supplies the electrical power in the internal power mode, and the backup power mode is used when the engine and generator unexpectedly stop generating and supplying electrical power. For example, a battery (e.g., a battery pack, a single battery, or the like) supplies the electrical power in the internal power mode, and the backup power mode is used when the battery unexpectedly stops supplying electrical power.

Aspects:

Any of Aspects 1-11 can be combined with any of aspects 12-18.

Aspect 1. A compressor for compressing a working fluid in a heat transfer circuit, comprising: a variable frequency drive (VFD) configured to utilize utility power; a permanent magnet motor electrically connected to the VFD, the permanent magnet motor configured to rotate a driveshaft; one or more gas bearings to support the driveshaft; a backup gas supply fluidly connected to the one or more gas bearings; and a switch-mode power supply electrically connected to the VFD, wherein during an interruption in the utility power, the switch-mode power supply is configured to utilize DC electrical power generated by a back electromotive force of the permanent magnet motor to operate the backup gas supply to provide a flow of compressed working fluid to the one or more gas bearings.

Aspect 2. The compressor of Aspect 1, further comprising: a controller to control the compressor, the controller configured to operate in a utility power mode and a backup power supply mode, wherein in the utility power mode, the VFD receives the utility power and supplies power to the permanent magnet motor to rotate the driveshaft and compress the working fluid, in the backup power supply mode, VFD generates the DC electrical power utilizing the back electromotive force of the permanent magnet motor, and the DC electrical power is used to power the controller to activate the backup gas supply.

Aspect 3. The compressor of either one of Aspects 1 and 2, wherein in the backup power supply mode, the controller operates the backup compressed gas source utilizing electrical power supplied from the switch-mode power supply utilizing the DC electrical power.

Aspect 4. The compressor of any one of Aspects 1-3, wherein the DC electrical power is supplied from the VFD to the switch-mode power supply.

Aspect 5. The compressor of any one of Aspects 1-4, wherein the back electromotive force causes the permanent magnet motor to supply an AC electrical power to the VFD, the VFD converting the AC electrical power into the DC electrical power.

Aspect 6. The compressor of any one of Aspects 1-5, wherein the electromotive force generates the DC electrical power in the VFD, and the DC electrical power is supplied from the VFD to the switch-mode power supply.

Aspect 7. The compressor of any one of Aspects 1-6, further comprising: a controller to control the compressor, the switch-mode power supply configured to supply electrical power with lower voltage than then the DC electrical power to the controller.

Aspect 8. The compressor of any one of Aspects 1-7, wherein the switch-mode power supply receives the DC electrical power generated by the electromotive force at a first voltage and the DC electrical supplied from the switch-mode power supply to the controller is at a second voltage lower than the first voltage.

Aspect 9. The compressor of any one of Aspects 1-8, wherein the backup compressed gas source includes a second compressor, the second compressor being configured operate by being powered by the switch-mode power supply utilizing the DC electrical power generated by the back electromotive force of the permanent magnet motor.

Aspect 10. The compressor of any one of Aspects 1-9, wherein the VFD includes an inverter electrically connected to the permanent magnet motor, the electromotive force of the permanent magnet motor generates AC electrical power supplied from the permanent magnet motor to the inverter, the inverter converting the AC electrical power into the DC electrical power.

Aspect 11. The compressor of any one of Aspects 1-10, wherein the VFD includes a rectifier, a DC link, and an inverter in series, the rectifier configured to receive utility power, and the switch-mode power supply is electrically connected between the DC link and the inverter.

Aspect 12. A method of operating an electric power supply system for a compressor in a heat transfer circuit, the compressor including a permanent magnet electric motor, a driveshaft, and one or more gas bearing for supporting the driveshaft, the method comprising: operating the electrical power supply system in a utility power mode, which includes: a variable frequency drive (VFD) receiving utility power, supplying electrical power from the VFD to the electric motor to rotate the driveshaft and compress working fluid, and providing a flow of the compressed working fluid to the one or more gas bearings; and operating the electrical power supply system in backup power mode during an interruption of the utility power, which includes: supplying to a switch-mode power supply DC electrical power generated in the VFD by an electromotive force of the motor, and utilizing, via the switch-mode power supply, the DC electrical power generated by the electromotive force to operate a backup gas supply to provide a flow of compressed working fluid to the one or more gas bearings.

Aspect 13. The method of Aspect 12, wherein supplying the DC electrical power generated in the VFD by the electromotive force of the motor to the switch-mode power supply includes: the back electromotive force causing the permanent magnet motor to supply AC electrical power to the VFD, and the VFD converting the AC electrical power into the DC electrical power.

Aspect 14. The method of either one of Aspects 12 and 13, wherein utilizing, via the switch-mode power supply, the DC electrical power generated by the electromotive force includes: the switch-mode power supply receiving the DC electrical power generated by an electromotive force at a first voltage, and the switch-mode power supply supplying DC electrical power at a second voltage lower than the first voltage.

Aspect 15. The method of any one of Aspects 12-14, wherein utilizing, via the switch-mode power supply, the DC electrical power generated by the electromotive force to operate a backup gas supply includes: converting, with the switch-mode power supply, the DC electrical power into electrical power with a lower voltage, and utilizing the electrical power with the lower voltage to operate the backup gas supply.

Aspect 16. The method of any one of Aspects 12-15, wherein the backup compressed gas source includes a second compressor, and in the backup power mode, the second compressor is configured to be powered by the switch-mode power supply to supply the flow of the compressed working fluid to the one or more gas bearings.

Aspect 17. The method of any one of Aspects 12-16, wherein the VFD includes an inverter electrically connected to the permanent magnet motor, and supplying the DC electrical power generated in the VFD by the electromotive force of the motor to the switch-mode power supply includes: generating, by the electromotive force of the permanent magnet motor, AC electrical power that is supplied from the permanent magnet motor to the inverter of the VFD, and converting, with the inverter, the AC electrical power into the DC electrical power.

Aspect 18. The method of any one of Aspects 12-17, wherein operating the electrical power supply system in the backup power mode includes initiating a shutdown of the compressor.

The terminology used in this specification is intended to describe particular embodiments and is not intended to be limiting. The terms "a," "an," and "the" include the plural forms as well, unless clearly indicated otherwise. The terms "comprises" and/or "comprising," when used in this specification, specify the presence of the stated features, integers, steps, operations, elements, and/or components, but do not preclude the presence or addition of one or more other features, integers, steps, operations, elements, and/or components. The use of "(s)" as applied herein is intended to mean "one or more" of the corresponding feature.

The examples disclosed in this application are to be considered in all respects as illustrative and not limitative. The word "embodiment" as used within this specification may, but does not necessarily, refer to the same embodiment. The scope of the invention is indicated by the appended claims rather than by the foregoing description; and all changes which come within the meaning and range of equivalency of the claims are intended to be embraced therein.

What is claimed is:

1. A compressor for compressing a working fluid in a heat transfer circuit, comprising:

a variable frequency drive (VFD) configured to utilize utility power;

a permanent magnet motor electrically connected to the VFD, the permanent magnet motor configured to rotate a driveshaft and compress the working fluid; one or more gas bearings configured to support the driveshaft using the compressed working fluid; a backup gas supply fluidly connected to the one or more gas bearings, the backup gas supply including one or more of a second compressor, a vessel, a vessel with a heater, and a condenser valve; and a switch-mode power supply electrically connected to the VFD, wherein during an interruption in the utility power, the switch-mode power supply is configured to utilize DC electrical power generated by a back electromotive force of the permanent magnet motor to operate the backup gas supply to provide a flow of compressed working fluid to the one or more gas bearings.

2. The compressor of claim 1, further comprising:

a controller to control the compressor, the controller configured to operate in a utility power mode and a backup power supply mode, wherein in the utility power mode, the VFD receives the utility power and supplies power to the permanent magnet motor to rotate the driveshaft and compress the working fluid, in the backup power supply mode, VFD generates the DC electrical power utilizing the back electromotive force of the permanent magnet motor, and the DC electrical power is used to power the controller to activate the backup gas supply.

3. The compressor of claim 2, wherein in the backup power supply mode, the controller operates the backup gas supply utilizing electrical power supplied from the switch-mode power supply utilizing the DC electrical power.

4. The compressor of claim 1, wherein the DC electrical power is supplied from the VFD to the switch-mode power supply.

5. The compressor of claim 1, wherein the back electromotive force causes the permanent magnet motor to supply an AC electrical power to the VFD, the VFD converting the AC electrical power into the DC electrical power.

6. The compressor of claim 1, wherein the electromotive force generates the DC electrical power in the VFD, and the DC electrical power is supplied from the VFD to the switch-mode power supply.

7. The compressor of claim 1, further comprising:

a controller to control the compressor, the switch-mode power supply configured to supply electrical power with lower voltage than then the DC electrical power to the controller.

8. The compressor off claim 1, wherein the switch-mode power supply receives the DC electrical power generated by the electromotive force at a first voltage and the DC electrical supplied from the switch-mode power supply to the controller is at a second voltage lower than the first voltage.

9. The compressor of claim 1, wherein the backup gas supply includes the second compressor, the second compressor being configured operate by being powered by the switch-mode power supply utilizing the DC electrical power generated by the back electromotive force of the permanent magnet motor.

10. The compressor of claim 1, wherein the VFD includes an inverter electrically connected to the permanent magnet motor, the electromotive force of the permanent magnet motor generates AC electrical power supplied from the permanent magnet motor to the inverter, the inverter converting the AC electrical power into the DC electrical power.

11. The compressor of claim 1, wherein the VFD includes a rectifier, a DC link, and an inverter in series, the rectifier configured to receive utility power, and the switch-mode power supply is electrically connected between the DC link and the inverter.

12. A method of operating an electric power supply system for a compressor in a heat transfer circuit, the compressor including a permanent magnet electric motor, a driveshaft, and one or more gas bearing for supporting the driveshaft, the method comprising:

operating the electrical power supply system in a utility power mode, which includes:

a variable frequency drive (VFD) receiving utility power, supplying electrical power from the VFD to the electric motor to rotate the driveshaft and compress working fluid, and providing a flow of the compressed working fluid to the one or more gas bearings; and operating the electrical power supply system in backup power mode during an interruption of the utility power, which includes:

supplying to a switch-mode power supply DC electrical power generated in the VFD by an electromotive force of the motor, and utilizing, via the switch-mode power supply, the DC electrical power generated by the electromotive force to operate a backup gas supply to provide a flow of compressed working fluid to the one or more gas bearings, the backup gas supply including one or more of a second compressor, a vessel, a vessel with a heater, and a condenser valve.

13. The method of claim 12, wherein supplying the DC electrical power generated in the VFD by the electromotive force of the motor to the switch-mode power supply includes:

the back electromotive force causing the permanent magnet motor to supply AC electrical power to the VFD, and the VFD converting the AC electrical power into the DC electrical power.

14. The method of claim 12, wherein utilizing, via the switch-mode power supply, the DC electrical power generated by the electromotive force includes:

the switch-mode power supply receiving the DC electrical power generated by an electromotive force at a first voltage, and the switch-mode power supply supplying DC electrical power at a second voltage lower than the first voltage.

15. The method of claim 12, wherein utilizing, via the switch-mode power supply, the DC electrical power generated by the electromotive force to operate the backup gas supply includes:

converting, with the switch-mode power supply, the DC electrical power into electrical power with a lower voltage, and utilizing the electrical power with the lower voltage to operate the backup gas supply.

16. The method of claim 12, wherein the backup gas supply includes the second compressor, and in the backup power mode, the second compressor is configured to be powered by the switch-mode power supply to supply the flow of the compressed working fluid to the one or more gas bearings.

17. The method of claim 12, wherein the VFD includes an inverter electrically connected to the permanent magnet motor, and supplying the DC electrical power generated in the VFD by the electromotive force of the motor to the switch-mode power supply includes:

generating, by the electromotive force of the permanent magnet motor, AC electrical power that is supplied from the permanent magnet motor to the inverter of the VFD, and converting, with the inverter, the AC electrical power into the DC electrical power.

18. The method of claim 12, wherein operating the electrical power supply system in the backup power mode includes initiating a shutdown of the compressor.

* * * * *